US008910944B2

(12) United States Patent
Mason, III

(10) Patent No.: US 8,910,944 B2
(45) Date of Patent: Dec. 16, 2014

(54) TARGET PRACTICE DEVICE

(71) Applicant: Russell Eugene Mason, III, Fayetteville, NC (US)

(72) Inventor: Russell Eugene Mason, III, Fayetteville, NC (US)

( * ) Notice: Subject to any disclaimer, the term of this patent is extended or adjusted under 35 U.S.C. 154(b) by 20 days.

(21) Appl. No.: 13/781,210

(22) Filed: Feb. 28, 2013

(65) Prior Publication Data

US 2013/0228975 A1 Sep. 5, 2013

Related U.S. Application Data

(60) Provisional application No. 61/634,493, filed on Mar. 2, 2012.

(51) Int. Cl.
*F41J 1/10* (2006.01)
*F41J 7/00* (2006.01)

(52) U.S. Cl.
CPC ..... *F41J 1/10* (2013.01)
USPC ..... 273/407; 273/406; 273/403

(58) Field of Classification Search
USPC ..... 273/403–410
See application file for complete search history.

(56) References Cited

U.S. PATENT DOCUMENTS

| | | | | | |
|---|---|---|---|---|---|
| 398,186 | A * | 2/1889 | Rehfuss | 273/404 |
| 840,610 | A * | 1/1907 | Easdale | 273/404 |
| 1,928,768 | A * | 10/1933 | Sell et al. | 273/409 |
| 1,981,293 | A * | 11/1934 | Varrelman | 273/404 |
| 2,034,839 | A * | 3/1936 | Sheffield | 273/382 |
| 2,048,155 | A * | 7/1936 | Armantrout | 273/407 |
| 3,519,272 | A * | 7/1970 | De Vogelaere | 273/404 |
| 4,247,116 | A * | 1/1981 | McQuary | 273/394 |
| 4,317,572 | A * | 3/1982 | Iseli | 273/406 |
| 4,491,328 | A * | 1/1985 | Meyer | 273/403 |
| 4,548,414 | A * | 10/1985 | Denis | 273/367 |
| 5,169,157 | A * | 12/1992 | Salmon | 273/407 |
| 5,649,708 | A * | 7/1997 | Podlesny | 273/403 |
| 6,257,584 | B1 * | 7/2001 | Nasuti | 273/407 |
| 6,543,778 | B2 * | 4/2003 | Baker | 273/407 |
| 7,374,173 | B2 * | 5/2008 | Nasuti | 273/407 |
| 8,141,878 | B2 * | 3/2012 | Kuyl | 273/403 |
| 2008/0211190 | A1 * | 9/2008 | Smith | 273/407 |
| 2011/0260405 | A1 * | 10/2011 | Acker | 273/403 |

OTHER PUBLICATIONS

"Aquarium Lamp with Dolphins: Ocean in Motion Revolving Aquatic Scene." Banberry Designs. Product and ordering information, Amazon.com. Viewed online Feb. 28, 2013, at http:www.amazon.com/Aquarium-Lamp-Dolpins-Revolving-Aquatic/dp/B003XNB1HC.

"All Bull's-Eyes. No Bull. Delta McKenzie Targets." 2013 product catalog. 40 pages. Delta Sports Products, LLC. Dike, Iowa.

* cited by examiner

*Primary Examiner* — Mark Graham
(74) *Attorney, Agent, or Firm* — Coats & Bennett, P.L.L.C.

(57) ABSTRACT

A shooting practice target that includes a roll with an elongated sheet having multiple images. The sheet is movable across a shooting zone formed in a frame. The sheet is movable across the shooting zone to position each of the images for use as a target. A back support may be positioned behind (away from the user) the sheet to support and position the images for viewing by the user.

20 Claims, 12 Drawing Sheets

TARGET PRACTICE DEVICE

RELATED APPLICATION

The present application claims priority to provisional application no. 61/634,493 filed on Mar. 2, 2012 entitled "GameChanger target practice system" which is hereby incorporated by reference in its entirety.

BACKGROUND

Targets for use in target practice come in a variety of different shapes and sizes. Some targets include a single image, such as a bulls-eye pattern or a drawing of an animal such as a deer or elk. Other targets include multiple images such as multiple bulls-eye patterns or multiple animal images. Targets are available with the images in a variety of different sizes depending upon the needs of the user and their skill level.

Targets may also include a variety of different styles and constructions. The simplest targets are merely a sheet with one or more images. In use, these targets are attached to an object such that the image is visible to the shooter. Other targets include an image that is attached to a back support. The back support is designed to stop or slow the projectile being fired by the shooter, such as an arrow or small caliber firearm.

Existing targets each have a common aspect regardless of the size and style. These targets include the same one or more images at which the user aims and shoots. For example, the user aims and shoots at the same bulls-eye pattern or same animal image. This provides little-to-no variety to the shooter and results in a repetitive ordeal that may limit some of the enjoyment of target practicing. Further, the target does not offer the shooter any challenge for increased skill levels.

SUMMARY

The present application is directed to a target practice device that includes an elongated sheet with multiple images formed along its length. The sheet may be wound and unwound from tubes that hold the sheet to position one of the images within a shooting zone of the device. The user may align additional images within the shooting zone as desired by rotating the tubes to wind and unwind the sheet.

One embodiment is directed to a target for shooting practice. The target includes a frame defining a shooting zone, a first tube mounted at a first side of the frame, a second tube mounted at a second side of the frame on an opposing side of the shooting zone from the first tube, and an elongated sheet with a length measured between a first end and a second end and being wrapped around the first and second tubes with the first end positioned at the first tube and the second end positioned at the second tube. A number of images are formed on the sheet and are spaced apart along the length of the sheet. The tubes are rotatably mounted to the frame to rotate in a first direction to wind the sheet around the first tube and unwind the sheet from the second tube and move the images across the shooting zone in a first direction.

Another embodiment is directed to a target for shooting practice. The target includes a frame with opposing top and bottom sides and opposing first and second lateral sides. The frame includes a central section formed between the sides. The target also includes a back support positioned in the central section. The back support includes a first face oriented in a first direction and an opposing second face oriented in a second direction. The target also includes a roll with first and second tubes and an elongated sheet that is wound onto the tubes. The first tube is rotatably mounted to the frame on a first side of the central section and the second tube is rotatably mounted to the frame on a second side of the central section with a portion of the sheet extending across the central section. The sheet includes a length measured between a first end positioned at the first tube and a second end positioned at the second tube that is greater than a distance across the central section between the tubes. The sheet includes a number of images that are spaced apart between the first and second ends. The roll is positionable at a variety of rotational orientations each having a different amount of the sheet wound around the first tube with each of the orientations including different ones of the images positioned in the central section of the frame with the remaining ones of the images being wound onto one of the first and second tubes.

One embodiment is directed to a method of using a target. The method includes mounting a first tube to a frame along a first side of a shooting zone, with the shooting zone being formed within an interior of the frame. The method includes mounting a second tube to the frame along an opposing second side of the shooting zone. The method also includes positioning a sheet that is partially wound around the first and second tubes across the shooting zone while sections of the sheet are wound around the first and second tubes, the sheet being longer than a distance between the first and second tubes. The method includes rotating each of the first and second tubes in a first direction and winding the sheet onto the first tube and unwinding the sheet from the second tube and aligning a first image on the sheet within the shooting zone. The method also includes rotating each of the first and second tubes an additional amount in the first direction and winding the sheet farther onto the first tube and unwinding the sheet farther off of the second tube and aligning a second image on the sheet within the shooting zone.

The various aspects of the various embodiments may be used alone or in any combination, as is desired.

DETAILED DESCRIPTION

The present application is directed to a target practice device with an elongated sheet of multiple images. The roll may be unwound and wound such that each image is positioned within a shooting zone for use as a target. This provides for the user to have practice with different images. The different images may be the same, or may have one or more different characteristics such as appearance, size, position within the shooting zone, etc. The device may be used with a variety of different weapons, such as a bow, crossbow, handgun, and rifle.

Figure 1:
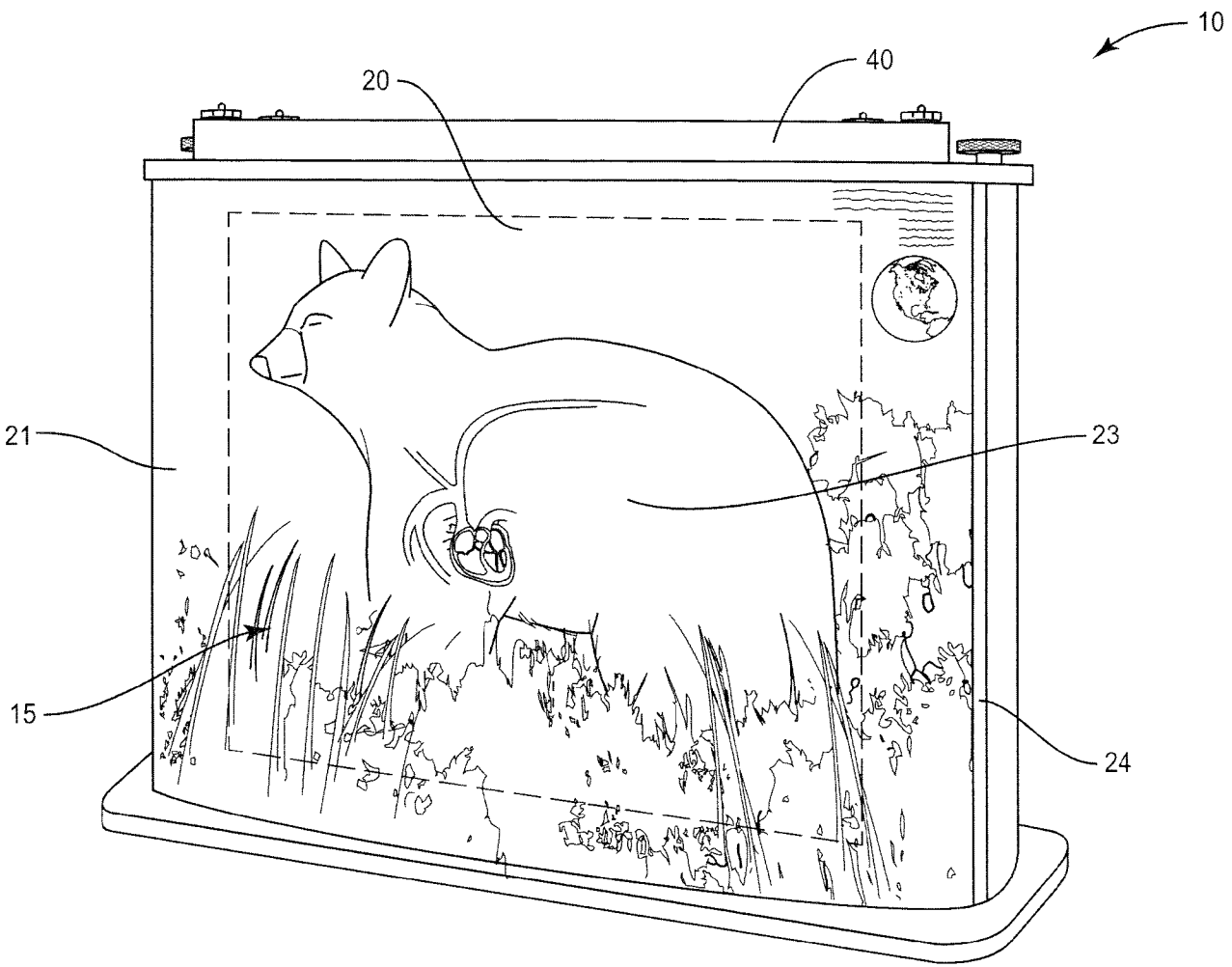
FIG. 1 is a perspective view of a target.

FIG. 1 illustrates an embodiment of a shooting practice device 10. The device 10 includes a roll 20 having an elongated sheet 21 with multiple images 23 each for use as a target. The sheet 21 is movable across a shooting zone 15 formed in a frame 40. The sheet 21 is movable across the shooting zone 15 to position each of the images 23 for use as a target. The shooting zone 15 is a portion or entirety of the front of the device 10 that faces towards the user where the target image 23 is displayed. A back support 30 may be positioned behind (away from the user) the sheet 21 to support and position the images 23 for viewing by the user.

Figure 2:
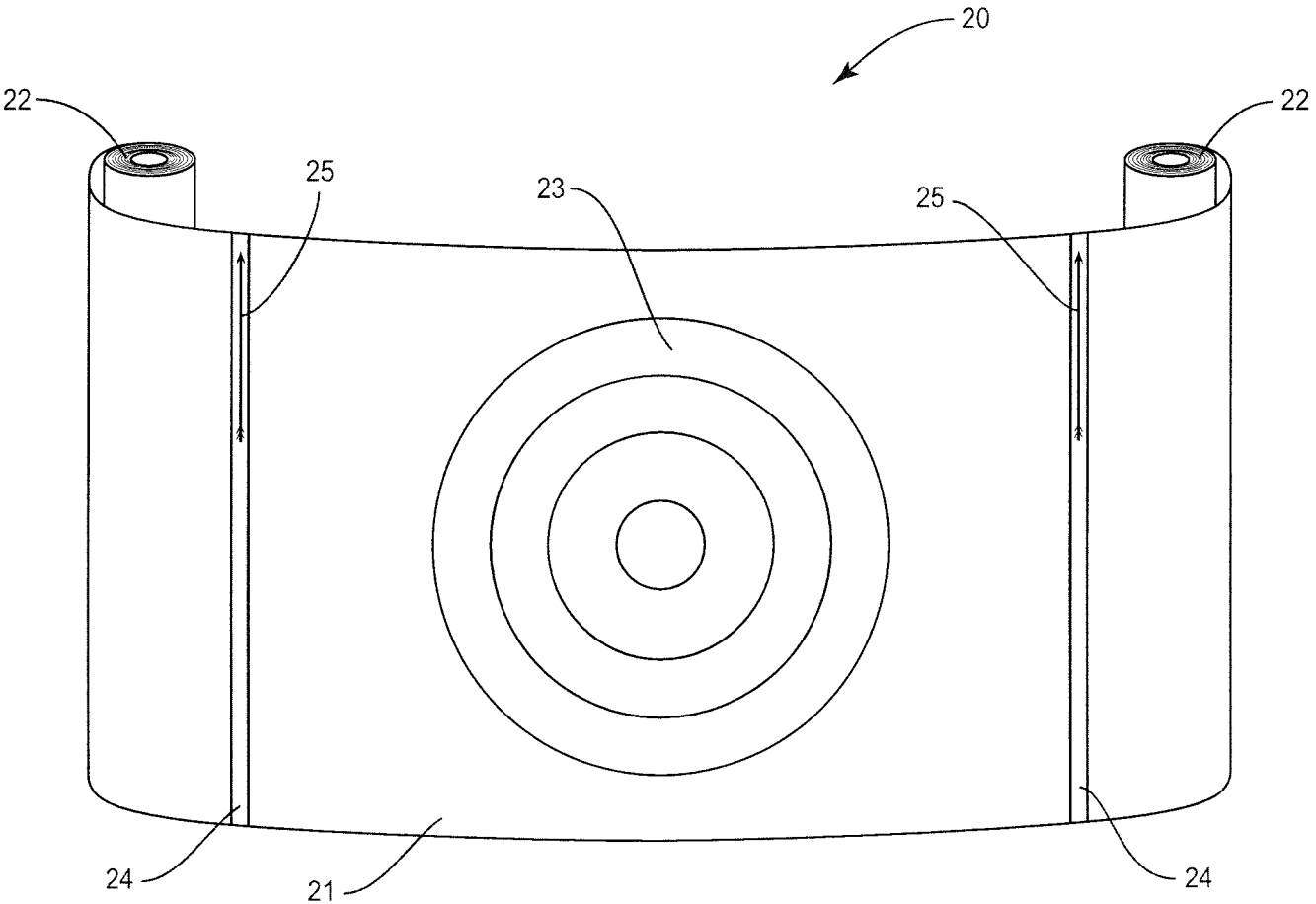
FIG. 2 is a perspective view of a roll that includes multiple images.

As illustrated in FIG. 2, the roll 20 includes an elongated sheet 21 with a first end that is wound around a first tube 22 and a second end that is wound around a second tube 22. The sheet 21 is flexible to enable winding around the tubes 22. Further, the sheet 21 is configured to be substantially flat along the section that extends between the tubes 22 and is positioned within the shooting zone 15. The sheet 21 may also remain wrinkle-free when rolled onto the tubes 22 to prevent distortion of the exposed image 23 which may degrade the visual clarity when viewed by the user. The sheet 21 may be constructed from a variety of materials. Examples include vinyl, re-enforced vinyl, paper, paper with plastic laminate, KEVLAR, and TYVEK. In one embodiment, the sheet 21 is weather-proof such that it may be stored outdoors without adverse effects.

The sheet 21 includes a number of images 23 spaced apart along the length. In one embodiment, each image 23 is spaced apart such that it can be positioned within the shooting zone 15 without the adjacent images being visible to the user. Gaps 24 may be formed on the sheet 21 between the adjacent images 23. The gaps 24 have a different visual appearance than the adjacent images 23 and provide a visual indicator to the user when aligning the targeted image 23 within the shooting zone 15. In one embodiment, the gaps 24 each include indicia 25, such as an arrow, that is aligned with an indicator such as indicia 49 (see FIG. 10) on the frame 40.

The number of images 23 on the roll 20 may vary. In one specific embodiment, the roll 20 includes five images 23. The roll 20 may include the images 23 on a first side, with an opposing second side being blank. The roll 20 may be mounted on the frame 40 such that either side faces the user. In a first orientation, the roll 20 is mounted for the images 23 to face the user. In a second orientation, the roll 20 is mounted such that the blank second side faces the user. The blank side may provide for the user to draw or otherwise form their own images as they desire for use in shooting practice. The length measured between the ends and the height may vary depending upon the device 10.

A variety of different images 23 may be formed on the roll 20. The images 23 may be photographs, hand drawings, computer images, etc. The images 23 may have a variety of themes, such as animals, games such as a dartboard or roulette wheel, nature scenes such as a tree, a logo of a sports team, etc. Each of the images 23 on a roll 20 may be the same or different type (e.g., each image is a photograph), and may have the same or different themes. In one embodiment, each roll 20 has images 23 of a particular theme that is selected by the user. Examples include a North American big game roll, African big game roll, sports team logo roll, children games roll, bulls-eye roll, etc. In one embodiment, the roll 20 may include photographs or drawings submitted by the user and formed on the sheet 23.

Figure 3:
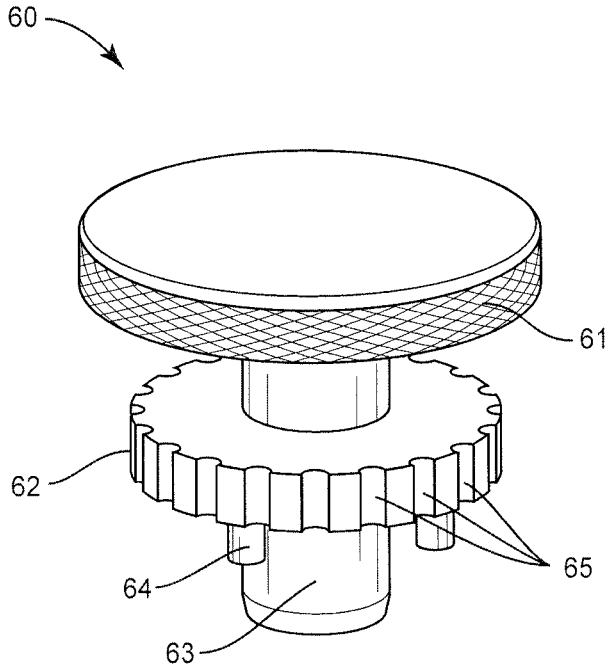
FIG. 3 is a perspective view of a cap that is attachable to a tube in a roll.

A cap 60 is mounted onto the top ends of each tube 22. FIG. 3 illustrates a cap 60 that includes a handle 61 and flange 62. An extension 63 and prongs 64 extend axially outward beyond the flange 62 to engage with the tube 22 and attach the cap 60. The flange 62 abuts against the top end of the tube 22. In one embodiment, the flange 62 includes circular shape and has indents 65 evenly spaced about the periphery.

The back support 30 supports the sheet 21 at the shooting zone 15. The back support 30 may also stop or reduce the speed of the projectile fired by the user. For example, the back support 30 may stop an arrow fired from a bow, and slow or stop buckshot fired from a shotgun.

Figure 4:
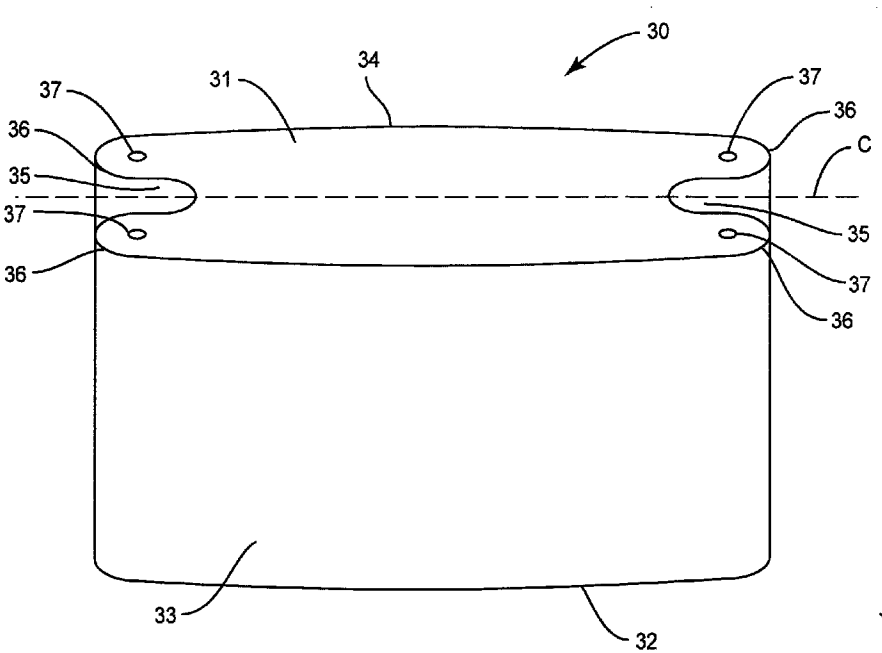
FIG. 4 is a perspective view of a back support.

In one embodiment, the back support 30 is shaped as illustrated in FIG. 4. The back support includes a top 31, bottom 32, front 33, back 34, and lateral sides 36. In one orientation, the front 33 faces towards the user and contacts against the back side of the sheet 21 to maintain it in a flat orientation for viewing by the user. Further, the front 33 supports the sheet 21 when hit by a fired projectile. Without the back support 30, the sheet 21 may be forced backward by a projectile and tear or wrinkle.

Figure 5:
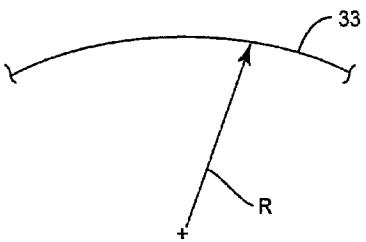
FIG. 5 is a schematic view of a front face of a back support.

The front face 33 may include a variety of shapes. In one embodiment as illustrated in FIG. 5, the front face 33 includes a curved shape. This shape causes the front face 33 to contact the sheet 21 throughout the shooting zone 15. In one embodiment, the curvature includes a constant radius R across the front face 33 between lateral sides 36. The radius R of the curvature may vary. In one embodiment, the radius R is about 36".

The back support 30 also includes indents 35 positioned at the lateral sides 36. The indents 35 are sized to receive the tubes 22 when the roll 20 is mounted to the frame 40. Positioning the tubes 22 in the indents 35 visually obscures the tubes 22 from the user. This positioning also reduces an overall size of the device 10. Further, this positioning protects the tubes 22 from the projectiles as a portion of the back support 30 is positioned between the tubes 22 and the user.

The section of the lateral sides 36 between the indents 35 and the front face 33 may include a curved shape. This curved section is contacted by the sheet 21 as it extends from the tube 22 across the front face 33. The curvature supports the sheet 21 and prevents damage that may occur if these sections were to have a sharper edge.

The back support 30 may be shaped such that it can be reversed in the frame 40 with the back face 34 facing towards the user and supporting the sheet 21. This may be advantageous to prolong the useful life of the back support 30. After a number of projectiles have been fired into the front face 33, this section may sustain expected damage and may not be able to fully support the sheet 21. The back support 30 may then be reversed such that the back face 34 now faces towards the user. The back face 34 receives substantially less damage when facing away from the user and is therefore in good condition to support the sheet In one embodiment as illustrated in FIG. 4, the back support 30 includes a symmetrical shape about a centerline C. Thus, the back face 34 and back section of the lateral sides 36 include the same curvature as the front face 33 and front section of the lateral sides 36. In other embodiments, the front and back faces 33, 34 include different shapes. In one embodiment, at least one of the faces 33, 34 is substantially flat.

The back support 30 may be formed by a variety of different materials. Examples include polyethylene foam, textile scraps, solid foam, card board layers, and recycled foam scraps formed into a solid mass. In one specific embodiment, the back support is constructed from 3.5 lb density polyethylene foam.

Figure 6:
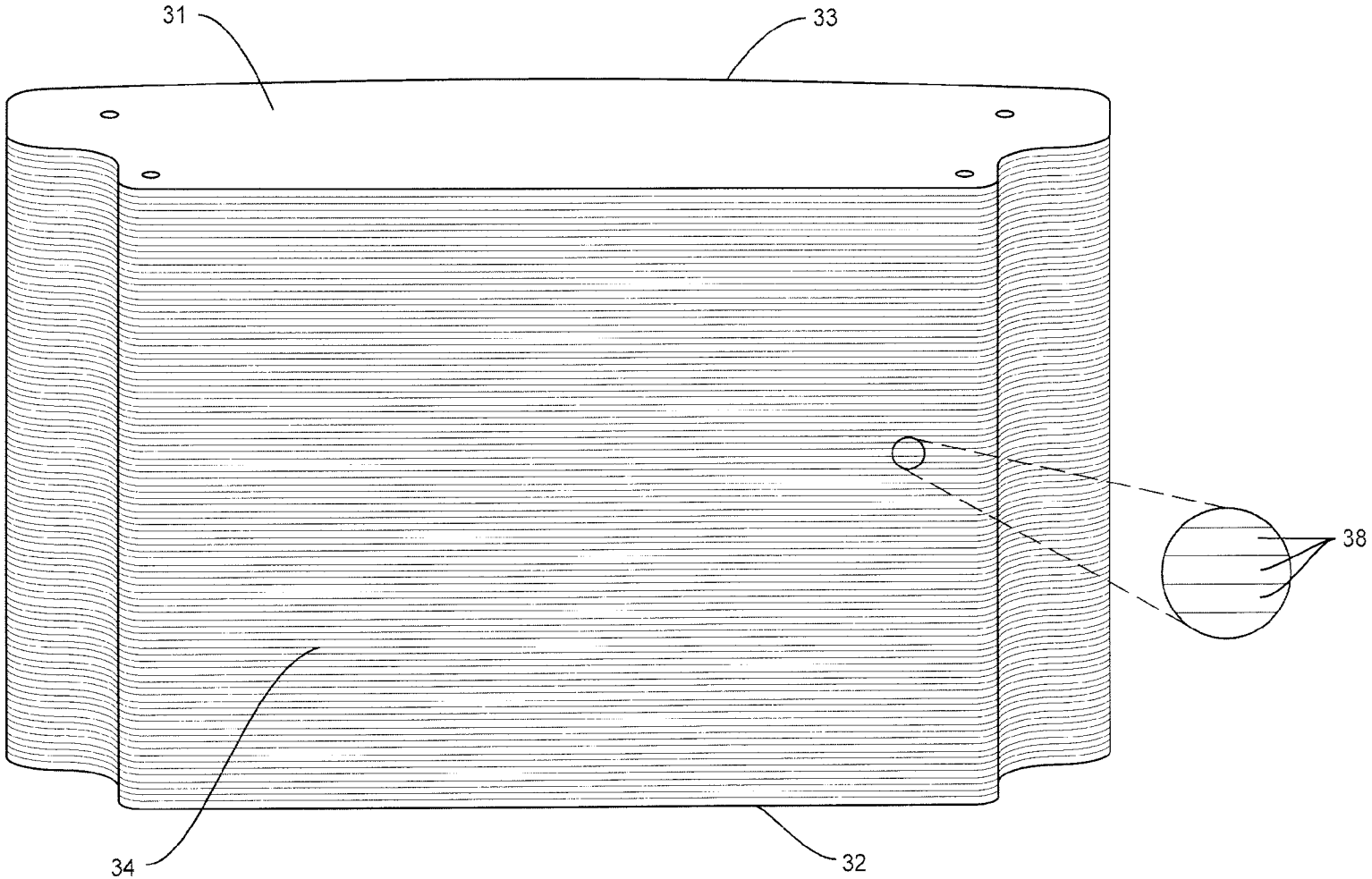
FIG. 6 is a perspective view of a back support.

The back support 30 may be a single piece. Alternatively, the back support 30 may be constructed from multiple different pieces. In one embodiment as illustrated in FIG. 6, each of the pieces 38 forms a different layer. The pieces 38 are stacked together in a vertical manner to form the back support 30. The pieces 38 may include the same or different shapes and/or sizes.

Figure 7:
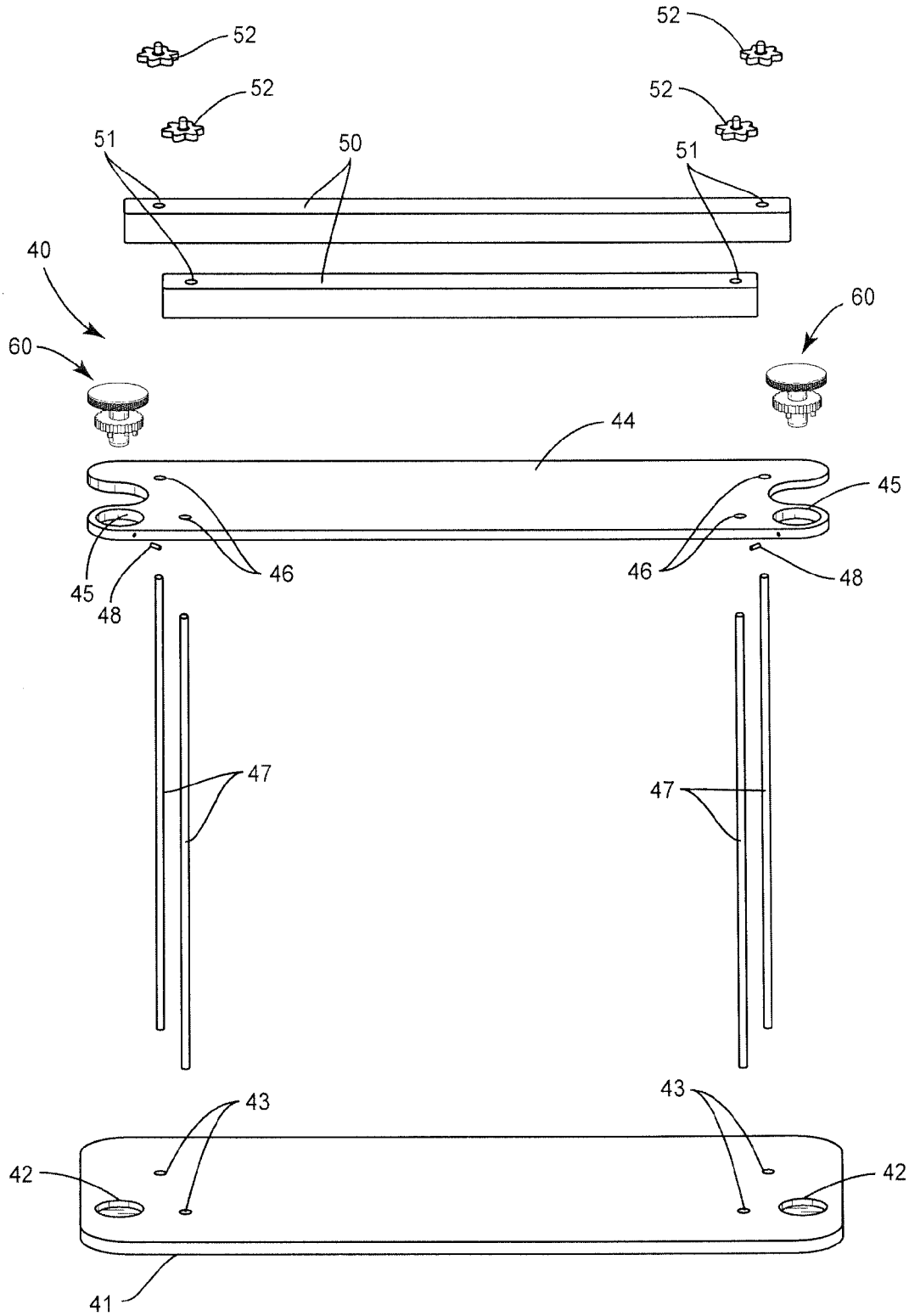
FIG. 7 is an exploded perspective view of a frame.

The frame 40 provides support and positioning to the roll 20 and back support 30. FIG. 7 illustrates an exploded view of the frame 40 that includes a base plate 41 and a top plate 44. Each of the plates 41, 44 is substantially flat and has a relatively small thickness. Each plate 41, 44 includes openings 43, 46 respectively to receive rods 47. The plates 41, 44 may include different shapes as illustrated in FIG. 7, or they may have the same shape.

The base plate 41 includes a pair of receptacles 42 for receiving and positioning the bottom ends of the tubes 22. The receptacles 42 are configured to maintain the position of the tubes 22, yet allow for rotation to wind and unwind the sheet 21. In one embodiment, the receptacles 42 include a hemispherical projection with a surrounding groove. The center of the tube is positioned over the projection with the bottom end of the tube 22 fitting into the groove. Another embodiment includes a circular groove machined into the top surface of the base plate 41. The receptacles 42 may be formed in the base plate 41, or may be one or more separate elements attached to the base plate 41.

The top plate 44 includes a pair of openings 45 each sized to receive one of the caps 60 that is attached to the tube 22. Each of the openings 45 is sized to receive the flange 62 of the cap 60. A pin 48 may be operatively attached to the top plate 44 and includes a spring to be biased outward into the opening 45. The pin 48 is positioned to contact against and slide along the outer periphery of the flange 62. The indents 65 in the flange 62 result in a ratcheting action as the cap 60 and attached tube 22 are rotated relative to the frame 40. The ratcheting action provides for the user to hear and also tactilely feel the rotation of the tube 22. The caps 60 attached to each tube 22 may be the same such that a user can compare the rotation of each tube 22 to properly position the sheet 21 and an image 23 in the shooting zone 15.

One or more rods 47 extend between the base and top plates 41, 44. The rods 47 are spaced in proximity to the lateral sides of the frame 40 such that the shooting zone 15 is open (i.e., free of frame elements). The rods 47 may be threaded along an entirety or a limited length. In one embodiment, the rods 47 extend through the openings 43 in the base plate 41 and are maintained in position by threaded fasteners (not illustrated) on the bottom of the base plate 41. The rods 47 may also extend through the top plate 44 and are engaged by caps 52.

Elongated bars 50 may be positioned on the top side of the top plate 44. The bars 50 include a length to extend across the majority of the top plate 44. Bars 50 include openings 51 such that the rods 47 can extend through and be secured by the caps 52. The bars 50 function to distribute a downward force on the back support 30 when the caps 52 are tightened onto the rods 47. The bars 50 distribute the force across the length of the back support 30. This downward force further strengthens the back support 30, particularly in embodiments in which the back support 30 is constructed from multiple pieces in a layered configuration. The number of bars 50 may vary depending upon the context of use.

The frame 40 may be constructed from a variety of materials, including various metals, plastics, high-density polyethylene, carbon fiber, and fiberglass. The various elements of the frame 40 may be constructed from the same or different materials.

Figure 8:
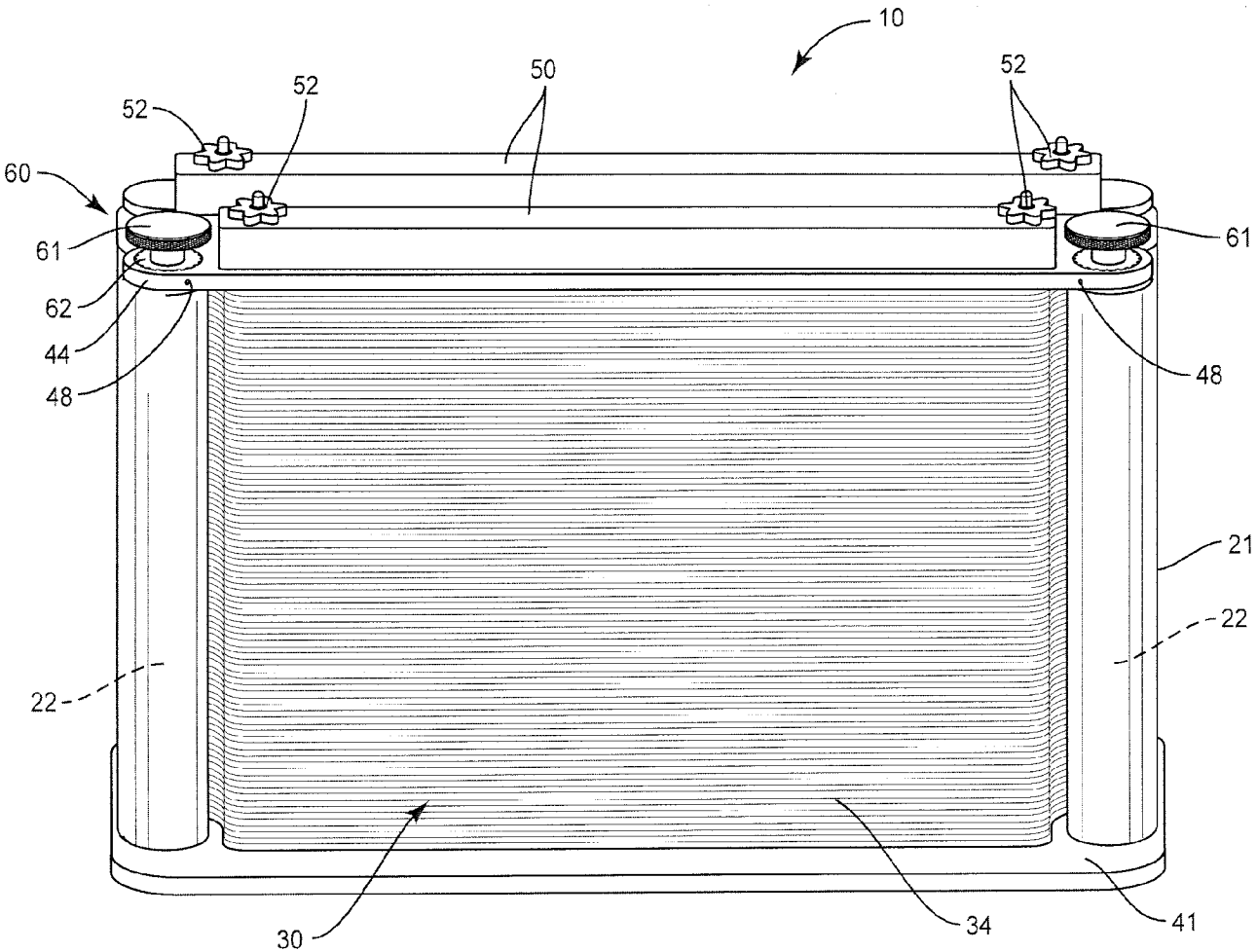
FIG. 8 is a perspective view of a back side of a target.

FIG. 8 illustrates a back view of the device 10. The back support 30 is positioned in the central portion between the base plate 41 and the top plate 44. The tubes 20 with portions of the wound sheet 21 are positioned on the lateral sides of the back support 30. This positions the rolls 20 and wound sheet 21 away from the shooting zone 15 to reduce or eliminate damage from the projectiles that are fired at the target. The back support 30 is further positioned in front of the tubes 22 and wound sheet 21 (i.e., between the tubes 22 and user) for further protection during use of the device 10.

The tubes 22 are further positioned on an exterior of the device 10 to be accessible to the user to change the roll 20. The user is not required to disassemble the frame 40 or move/disassemble the back support 30 to replace the roll 20.

In use, the user removes the caps 60 from the tubes 22 of the existing roll 20, removes the tubes 22 laterally from between the plates 41, 44. Once removed, the user reverses the process by inserting the tubes 22 of a new roll 20 between the plates 41, 44 with the bottom end of the tubes 22 positioned on the receptacles 42 of the base plate 41 and the upper end of the tubes 22 aligned with the openings 45 in the top plate 44. The caps 60 are then inserted downward through the openings 45 and into engagement with the tubes 22. The flange 62 of each cap 60 extends across its respective opening 45. The flange 62 may prevent water or debris from entering into the tube 22, particularly when the device 10 is stored outdoors. In one embodiment as illustrated in FIG. 8, the flange 62 is positioned substantially flush with the top surface of the top plate 44.

The flange 62 is further aligned with the opening 45 such that the outer periphery contacts against the pin 48 mounted into the top plate 44. This provides for a ratcheting action when the cap 60 and tube 22 are rotated in either direction. FIG. 8 includes the pin 48 mounted in an opening in the top plate 44. The pin 48 may also be attached to a top or bottom side of the top plate 44, or associated with the bottom plate 41 to perform a similar function.

The frame 40 is further configured to facilitate replacing a limited section or entirety of the back support 30. The user removes the caps 52 from the top of the frame 40, and further removes the bars 50 and top plate 44. The user may then remove the back support 30 from the device 10. In one embodiment, the back support 30 can be replaced by a new back support 30. In another embodiment, the back support 30 may be rotated such that the back face 34 now faces towards the user to prolong the life of the back support as discussed above. In these embodiments, the roll 20 may be removed from the device 10 prior to addressing the back support 30. Alternatively, the roll 20 may remain in the device 10.

Figure 9:
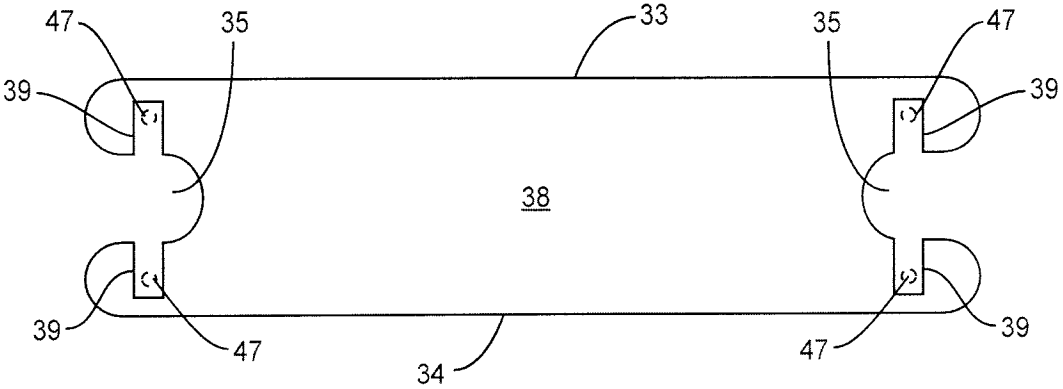
FIG. 9 is a top view of a piece of a back support.

In one embodiment in which the back support 30 is constructed from multiple pieces 38 in a layered configuration, it may only be necessary to remove just the damaged layers. In one embodiment, each of the layers above the damaged layer is removed to provide access. In another embodiment, the user may be able to remove just the damaged layer(s) without removing the layers above. As illustrated in FIG. 9, the layered pieces 38 may be constructed to facilitate their individual removal. This embodiment includes the piece 38 having one or more cut-out sections 39. The cut-out sections 39 extend inward from an outer peripheral edge of the piece 38. In this embodiment, the cut-out sections 39 extend inward from the indents 35. The cut-outs are sized to extend around the rods 47 in the frame 40 that extends between the base plate 41 and the top plate 44. This configuration provides for the user to individually remove this piece 38 from the back support 30 without removing the other pieces. In some embodiments, each piece 38 may include one or more cut-outs 39, with other embodiments including just limited ones of the pieces 38 including cut-outs 39.

Figure 10:
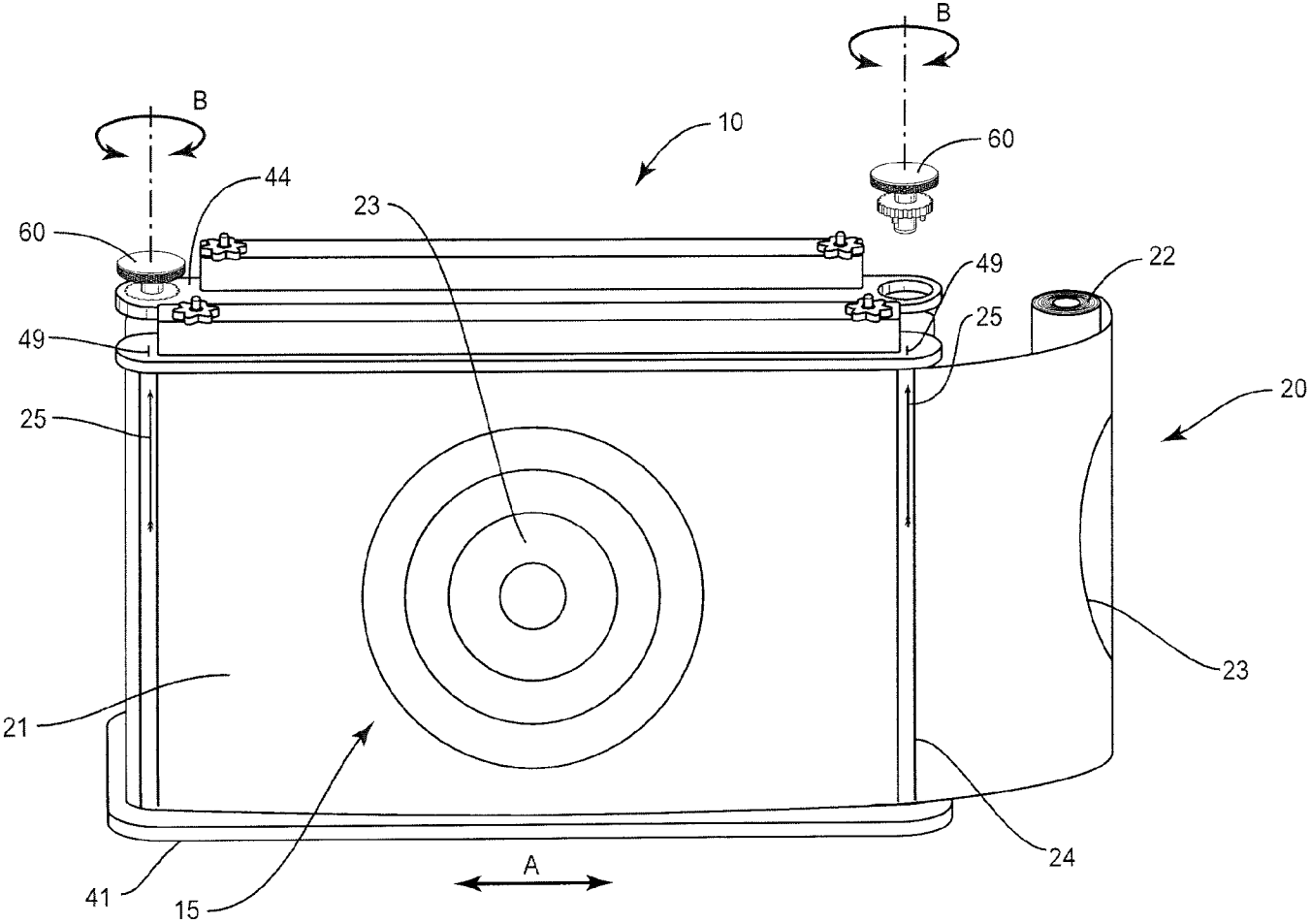
FIG. 10 is a perspective view of a roll partially mounted to a frame.

FIG. 10 illustrates a roll 20 being mounted to the device 10. The roll 20 includes a first tube 22 (not illustrated) configured to be mounted at a first lateral side of the device 10, and a second tube 22 configured to be mounted at a second lateral side of the device 10. In FIG. 10, the first tube 22 is mounted between the bottom and top plates 41, 44 of the frame 40 and the second tube is positioned to be mounted in the frame 40. The tubes 22 are laterally moved between the plates 41, 44 and a cap 60 is mounted to the top end of the tubes 22 to maintain the position.

The roll 20 includes the two tubes 22 and the elongated sheet 21 that is rolled onto the tubes 22. When the roll 20 is mounted to the frame 40, a portion of the sheet 21 is wound around the first tube 22 and a second portion is wound around the second tube 22.

The sheet 21 includes the images 23 that are spaced along the length. Each image 23 is sized to be positioned in the shooting zone 15 at a central section of the device 10. The sheet 21 may further include spacers 24 positioned between the adjacent images 23. The spacers 24 may be used to align the images 23 within the shooting zone 15.

To mount the roll 20, the user places a first tube 22 at a first lateral side of the frame with the bottom end of the tube 22 within the receptacle 42 in the base plate 41 and a top end of the tube 22 at the opening 43 in the top plate 44. The cap 60 may then be inserted into the opening 43 and attached to the top end of the tube 22. The user than extends the sheet 21 across the front face 33 of the back support 30. The sheet 21 contacts against and is supported by the back support 30. In one embodiment, the curved front face 33 provides for the sheet 21 to maintain contact with the back support 30 along the entirety of the front face 33. The sheet 21 further contacts against the curved sections of the lateral sides 36.

The user then attaches the second tube 22 into the opposing side of the frame 40. The second tube 22 may be attached in a similar manner with the bottom end of the tube 22 positioned within the receptacle 42 in the base plate 41 and the top end of the tube 22 positioned at the opening 43 in the top plate 44. The cap 60 is inserted into the opening 43 and attached to the top end of the tube 22.

Once the roll 20 is mounted to the frame 40, the user may rotate the caps 60 on the two tubes 22 in either direction (i.e., clockwise, counter-clockwise) as illustrated by arrows B to adjust the sheet 21. Initially, there may be slack in the sheet 21 from the attachment of the roll 20 with the frame 40. The user may initial rotate the caps 60 to remove the slack. Additional rotation of the caps 60 then causes the sheet 21 to be wound onto one of the tubes 22 and unwound from the opposing tube 22. The user may rotate the caps 60 in either direction to move the sheet in either lateral direction across the shooting zone 15 as illustrated by arrow A.

The user rotates the caps 60 to position the desired image 23 within the shooting zone 15. The length of the image 23 may be sized such that spacers 24 on both sides of the image are positioned at the lateral sides of the device 10 when the image 23 is aligned in the shooting zone 15. In one embodiment, the frame 40 may include indicia 49, such as an arrow on the top plate 44, that the user visually aligns with the spacer 24 and/or indicia 25 to align the image 23 in the shooting zone 15. The spacer 24 may likewise include indicia 25 (see FIG. 2) that is aligned with the corresponding indicia 49 on the top plate 44.

With the image 23 aligned in the shooting zone 15, the sheet 21 is in contact with and supported by the back support 30. The back support 30 may prevent the sheet 21 from sagging, folding, or otherwise distorting which could visual obscure the image 23. Further, the back support 30 supports the sheet 21 when the projectiles contact the sheet 21.

The user is able to change to another image 23 on the roll 20 by rotating the caps 60 and winding the sheet 21 to expose the desired image 23. In one embodiment, the user simultaneously rotates both caps 60 to move the sheet 21. In another embodiment, the user rotates the cap 60 of the leading tube 22 which pulls the sheet 21 and thus causes rotation of the trailing tube 22. The user adjusts the sheet 21 until the desired image 23 is aligned in the shooting zone 15. The user may adjust the sheet 21 such that the image 23 is aligned in the shooting zone 15 and the spacers 24 and/or indicia 25 are aligned with indicia 49 on the top plate 44 of the frame 40. Alternatively, the user may position the sheet 21 such that the image 23 is not fully positioned in the shooting zone 15. This may be preferred for an experienced shooter who desires to aim at a smaller target.

The user may continue to wind and unwind the roll 20 as desired to use each of the images 23 on the sheet as a target. The user may then remove the roll 20 when the sheet 21 has been used for an extended amount of target practice and the images are no longer visible or the integrity of the sheet 21 has been compromised. Alternatively, the user may attach a new roll 20 at any time that they want to have different images 23. By way of example, the user may initially mount a first roll 20 with images 23 of various North American animals. The user may then remove the first roll 20 and mount a second roll 20 that includes various images of games. The number of images 23 on a roll 20 may vary.

Figure 11:
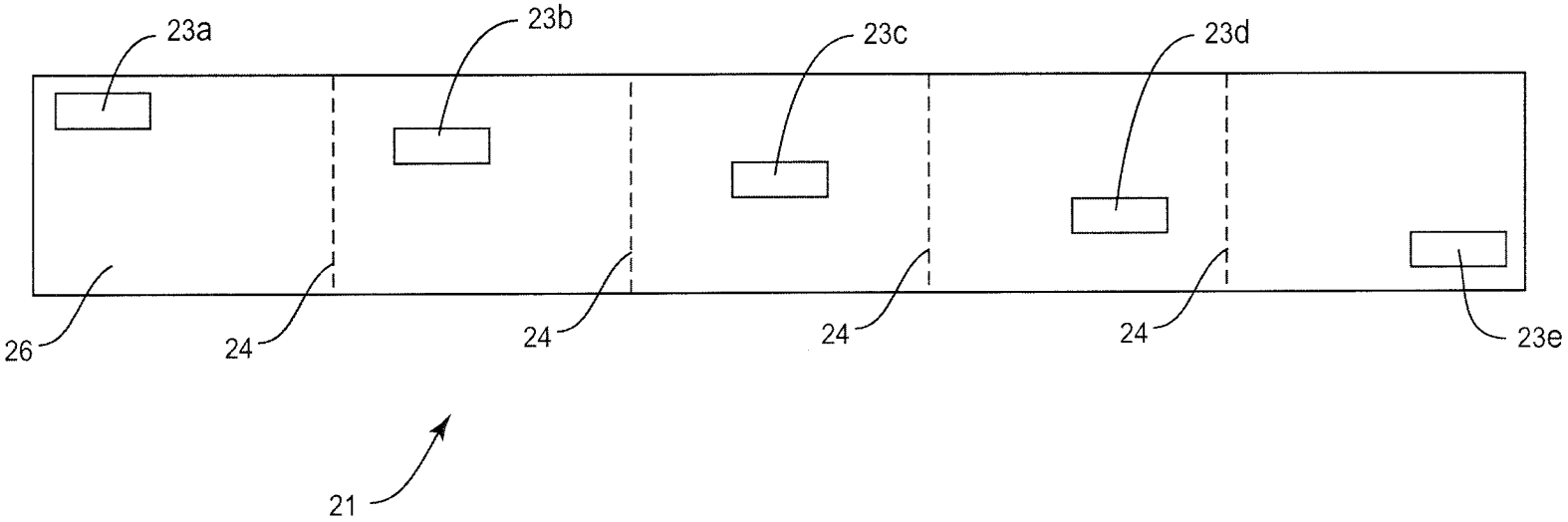
FIG. 11 is a schematic view of a sheet of a roll with multiple images spaced at offset locations within image windows.

In one embodiment as illustrated in FIG. 11, the roll 20 includes a number of different images 23*a*-23*e* that may be aligned within the shooting zone 15. Each of the images 23*a*-23*e* may be positioned at a different location within the shooting zone 15. Offsetting the images 23 positions the images at different locations relative to the back support 30. This distributes the damage that will be inflicted to the back support 30 by the projectiles across the back support 30 as opposed to if each image 23 was located at the same position relative to the back support 30 when aligned in the shooting zone 15. Using FIG. 11 as an example, the first image 23*a* is located at a first position relative to the back support 30 when aligned in the shooting zone 15, the second image 23*b* is offset at a second position relative to the back support 30 when aligned in the shooting zone 15, etc.

FIG. 11 includes the images 23 being offset from one another. In a similar embodiment, the images 23 may each be located at substantially the same location relative to the back support 30 when the images are each aligned in the shooting zone 15. However, each image 23 may include a specific target that is offset from the targets of other images 23. By way of example, the sheet 21 may include multiple different images 23 of animals, such as animals of North America or Africa. Each animal image 23 is positioned to be located at the same position relative to the back support 30 when aligned in the shooting zone 15. Each animal image 23 further includes a specific target where a hunter would attempt to shoot the animal, such as the heart, lungs, shoulders, etc. These specific targets are offset in each image to distribute the damage inflicted to the back support 30.

As disclosed above, the back support 30 may have a considerable thickness measured between the front and back faces 33, 34. This provides for the back support 30 to stop or slow a projectile that is shot from a user. In one embodiment, the back support 30 will stop an arrow that is shot from a bow. The device 10 may also be used for various firearms, such as handguns, shotguns, rifles, etc. In these embodiments, the back support 30 may not be configured to stop the projectile. Therefore, the back support is constructed to just support the sheet 21.

Figure 12:
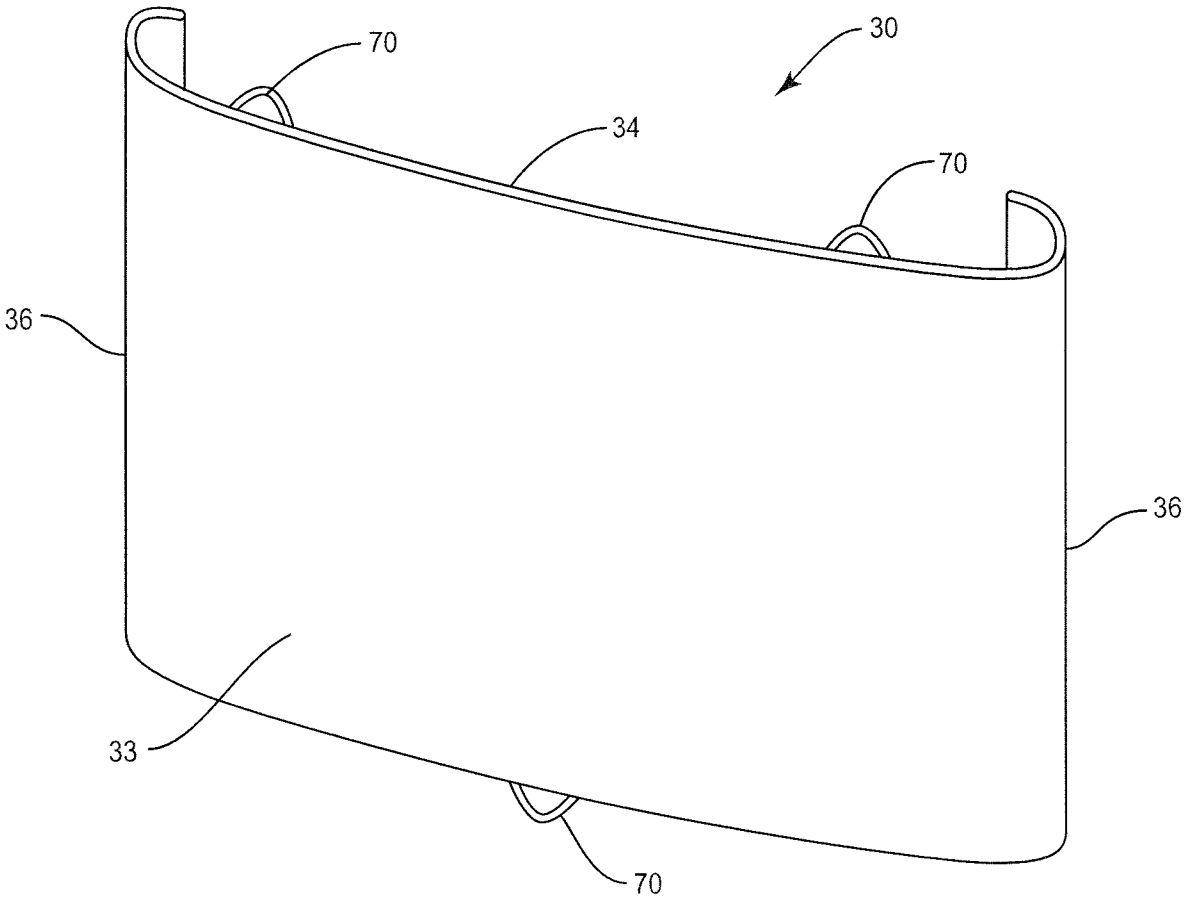
FIG. 12 is a perspective view of a back support.

FIG. 12 illustrates an embodiment of a back support 30 that does not stop the projectile. The back support 30 is relatively thin. The front face 33 is shaped to contact and support the sheet 21 in a similar manner as described in the above embodiments. The front face 33 may include a curved shape with a radius R as described above. The lateral sides 36 may be curved to further support the sheet 21 and prevent damage during movement in either direction. The back support 30 may be configured to attach to the frame 40 in a variety of manners. In one embodiment, the ends are configured to extend around and connect to a rod 47. In another embodiment, fasteners (not illustrated) extend through the back support 30 and into the frame 40. Fasteners may include screws, rivets, bolts, pins, etc. The back support 30 may also include brackets 70 to receive the fasteners.

The roll 20 may include tubes 22 for holding the sheet 21. Alternatively, the roll 20 may simply include the elongated sheet 21. The tubes 22 may be part of and permanently or removably mounted to the frame 40. When the user mounts a new roll 20 to the device 10, the user attaches a first end of the sheet 21 to the first tube 22 and a second end of the sheet 21 to the second tube 22. The user may then rotate the tubes 22 accordingly to position the desired image within the shooting zone 15.

Figure 13:
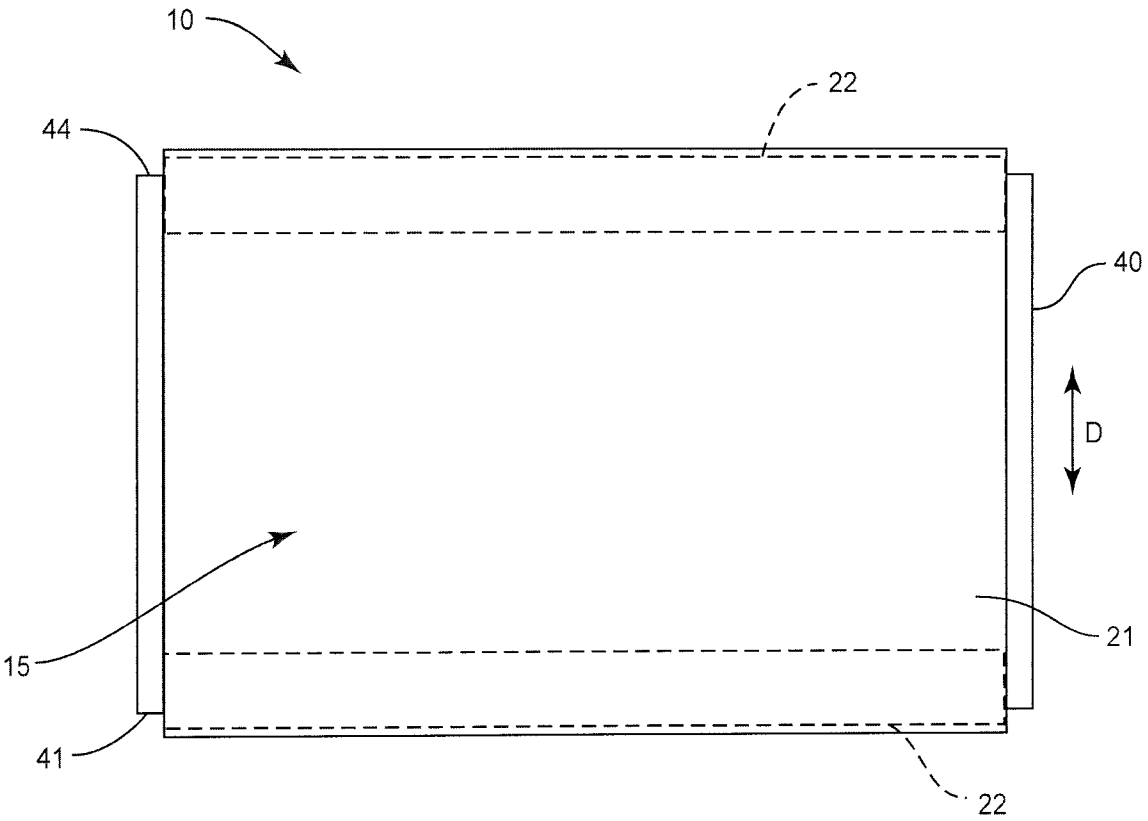
FIG. 13 is a schematic view of a target.

The various embodiments disclosed above include the device 10 being arranged in a horizontal orientation. The sheet 21 extends horizontally between the base plate 41 and the top plate 44 with the tubes 22 positioned at the opposing lateral sides. The device 10 may also include a vertical orientation with the sheet extending vertically as illustrated in FIG. 13. A first tube 22 is positioned at the top plate 44 and a second tube 22 is positioned at the bottom plate 41. The sheet 21 moves in a vertical direction as illustrated by arrow D when the tubes 22 are rotated by the user.

In one embodiment, the target practice device 10 does not include a back support 30.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A target for shooting practice comprising:

a frame defining a shooting zone;

a first tube mounted at a first side of the frame;

a second tube mounted at a second side of the frame on an opposing side of the shooting zone from the first tube;

a back support within the frame at the shooting zone and including a front face, an opposing back face, a first lateral side in proximity to the first tube that includes a first indent, and a second lateral side in proximity to the second tube that includes a second indent, each of the first and second lateral sides extending between the front and back faces;

an elongated sheet with a length measured between a first end and a second end and being wrapped around the first and second tubes, the first end positioned at the first tube and the second end positioned at the second tube, the sheet extending in front of and being in contact with the front face of the back support across the shooting zone;

the first tube positioned in the first indent and the second tube positioned in the second indent;

a plurality of images formed on the sheet and being spaced apart along the length of the sheet; and the tubes being rotatably mounted to the frame to rotate in a first direction to wind the sheet around the first tube and unwind the sheet from the second tube and move the images across the shooting zone in a first direction.

2. The target of claim 1, wherein the tubes are rotatably mounted to the frame to rotate in a second direction and wind the sheet around the second tube and move the images across the shooting zone in a second direction that is opposite from the first direction.

3. The target of claim 1, further comprising a ratcheting mechanism operatively connected to the frame and including a pin that is biased towards the first tube and contacts a plurality of indents of the tube.

4. The target of claim 1, wherein each of the images includes a visible aim point, the aim point of each of the images is positioned at a different location within the shooting zone when the images are moved across the shooting zone.

5. The target of claim 1, wherein the first tube includes a cap with a handle that extends outward beyond a top plate of the frame.

6. The target of claim 1, wherein each of the first and second lateral sides between the indent and the front face comprise a curved shape that supports the sheet.

7. The target of claim 1, wherein the back support includes a symmetrical shape about a longitudinal centerline with the front face and a front portion of the first and second lateral sides being the same as the back face and a back portion of the first and second lateral sides.

8. A target for shooting practice comprising:

a frame forming an open central section;

a back support positioned in the central section, the back support including a first face orientated in a first direction and an opposing second face oriented in a second direction, the back support also comprising lateral sides that extend between the first and second faces; and a roll with first and second tubes and an elongated sheet that is wound onto the tubes, the first tube being rotatably mounted to the frame on a first side of the central section and the second tube being rotatably mounted to the frame on a second side of the central section with a portion of the sheet extending across the central section in front of and in contact with the first face of the back support, each of the first and second tubes being positioned within the lateral sides and behind the first face of the back support to prevent contact with a projectile;

the sheet including a length measured between a first end positioned at the first tube and a second end positioned at the second tube that is greater than a distance across the central section between the tubes, the sheet further comprising a plurality of images spaced apart between the first and second ends;

the roll being positionable at a variety of rotational orientations each having a different amount of the sheet wound around the first tube, each of the orientations including different ones of the images positioned in the central section of the frame with the remaining ones of the images being wound onto one of the first and second tubes.

9. The target of claim 8, wherein the sheet extends in a horizontal orientation across the frame with the first tube positioned on the first lateral side of the frame and the second tube positioned on the second lateral side of the frame with the back support comprising curved lateral sides that extend between the first and second faces and that contact against and support the sheet.

10. The target of claim 8, wherein the sheet extends in a vertical orientation across the frame with the first tube positioned at the top side and the second tube positioned at the bottom side.

11. The target of claim 8, wherein the first face extends between opposing sides of the back support, the front face including a curved shape with a constant radius to contact the sheet across the central section.

12. The target of claim 8, wherein each of the images is located at a different offset position relative to the back support when the images are aligned within the central section of the frame.

13. The target of claim 8, wherein the sheet is positioned against the first face of the back support along a substantial portion of the central section.

14. The target of claim 8, wherein the back support includes indents along opposing lateral sides with the back support including a symmetrical shape about a longitudinal centerline with the first face and a front portion of the lateral sides being the same as the second face and a back portion of the lateral sides.

15. A method of using a target comprising:

mounting a first tube to a frame along a first side of a shooting zone, the shooting zone being formed within an interior of the frame;

mounting a second tube to the frame along an opposing second side of the shooting zone;

positioning a sheet that is partially wound around the first and second tubes across the shooting zone and in front of and in contact with a back support that is positioned in the frame and extends across the shooting zone while sections of the sheet are wound around the first and second tubes, the sheet being longer than a distance between the first and second tubes;

rotating each of the first and second tubes in a first direction and moving the sheet across curved lateral edges of the back support and winding the sheet onto the first tube and unwinding the sheet from the second tube and aligning a first image on the sheet within the shooting zone; and rotating each of the first and second tubes an additional amount in the first direction and moving the sheet across the curved lateral edges of the back support and winding the sheet farther onto the first tube and unwinding the sheet farther off of the second tube and aligning a second image on the sheet within the shooting zone.

16. The method of claim 15, further comprising winding the portion of the sheet that includes the first image onto the first tube while aligning the second image within the shooting zone.

17. The method of claim 15, wherein the second image is wound onto the second tube when the first image is aligned within the shooting zone and the first image is wound onto the first tube when the second image is aligned within the shooting zone.

18. The method of claim 15, further comprising rotating each of the first and second tubes in an opposing second direction and winding the section of the sheet with the second image onto the second tube and unwinding the section of the sheet with the first image from the first tube.

19. The method of claim 15, further comprising moving the sheet horizontally across the shooting zone.

20. The method of claim 15, further comprising contacting the sheet against a curved front face of the back support that is positioned in the frame with the sheet having a curved shape with a constant radius across the shooting zone.

* * * * *